US005157897A

United States Patent [19]

McKee et al.

[11] Patent Number: 5,157,897

[45] Date of Patent: Oct. 27, 1992

[54] ROTARY CAPPING MACHINE

[75] Inventors: Kyle A. McKee; Bryan M. Hankel, both of Richmond, Ind.

[73] Assignee: Aluminum Company of America, Pittsburgh, Pa.

[21] Appl. No.: 804,466

[22] Filed: Dec. 5, 1991

Related U.S. Application Data

[63] Continuation of Ser. No. 613,164, Nov. 13, 1990, abandoned.

[51] Int. Cl.[5] ..... B65B 7/28

[52] U.S. Cl. ..... 53/308; 53/317; 53/331.5

[58] Field of Search ..... 53/306, 308, 317, 331.5, 53/343, 357, 361, 362

[56] References Cited

U.S. PATENT DOCUMENTS

| | | | |
|---|---|---|---|
| 2,510,568 | 6/1950 | Fouse | 53/317 X |
| 2,610,779 | 9/1952 | Fouse | 53/87 |
| 2,996,853 | 8/1961 | Hohl | 53/343 X |
| 3,345,800 | 10/1967 | Volker | 53/303 |
| 3,643,398 | 2/1972 | Quest et al. | 53/306 X |
| 3,714,760 | 2/1973 | Roberts et al. | 53/308 X |
| 3,755,987 | 9/1973 | Dardaine et al. | 53/306 X |
| 4,178,732 | 12/1979 | Pfleger | 53/331.5 X |
| 4,205,502 | 6/1980 | Ahlers | 53/343 X |
| 4,222,215 | 9/1980 | Takano | 53/331.5 |
| 4,366,662 | 1/1983 | Katsura et al. | 53/478 |
| 4,696,144 | 9/1987 | Bankuty et al. | 53/331.5 |
| 4,989,394 | 2/1991 | Berg et al. | 53/361 X |

*Primary Examiner*—John Sipos
*Assistant Examiner*—Daniel B. Moon
*Attorney, Agent, or Firm*—Dressler, Goldsmith, Shore, Sutker & Milnamow Limited

[57] ABSTRACT

A rotary capping machine is disclosed for application of screw-on closure caps to bottles, jars, or other containers. The machine includes a guiding mechanism which insures that a cap is held in a proper position on a transfer mechanism of the machine. Capping head assemblies of this machine each include a magnetic pickup arrangement, with a friction tip provided for contact with the closure caps.

1 Claim, 3 Drawing Sheets

ROTARY CAPPING MACHINE

This application is a continuation of application Ser. No. 07/613,164, filed Nov. 13, 1990 now abandoned.

TECHNICAL FIELD

This invention relates to a rotary capping machine wherein a cap or closure is applied to a filled container. Such machines are used to automatically apply screw-on or turn-on closure caps to the tops of jars or similar containers and thereafter turn the caps into tight sealing relation on the jar.

BACKGROUND OF THE INVENTION

While rotary capping equipment has been around for some time, there are some inherent deficiencies in the currently existing capping equipment. Initially, it is important to insure that the cap is properly maintained in position on the cap transfer mechanism after it receives the cap from the cap hopper, so that the cap can be suitably withdrawn from the cap transfer mechanism in proper position to be carried to a location to be secured to a container. Another area of concern is that having to do with insuring that the cap is correctly and accurately removed by the capping head from the cap transfer mechanism and placed on the container without jamming or damaging the cap during the application process.

When the cap is received from a hopper feeding mechanism, it is disposed on a cap transfer mechanism such as a star wheel whereon it is then rotated into position to be picked up by a capping head on a capping turret, placed on and then tightly sealed on a filled container. It can be appreciated that in order to insure that there is a proper transfer from the star wheel to the capping head, the cap must be maintained properly positioned on the cap transfer mechanism so that when it is to be removed therefrom by the capping head it will be positioned relative to the capping turret in an orientation so that it will be accurately placed onto the filled container.

SUMMARY OF THE INVENTION

In order to accomplish the above goals, the present invention provides a guiding mechanism which insures that the cap is securely held in a proper location on the transfer star mechanism and will be maintained thereon in such position, so that when it is removed from the star mechanism it will be accurately positioned with respect to the capping head.

As an additional novel aspect of the present invention, our capping head assemblies include a magnetic pickup assembly that is moved down into position above the cap to magnetically engage the steel cap and transfer it from the star wheel to the capping turret. The cap is initially removed from the star wheel by the magnetic pickup assembly and retained in position relative thereto. The cap is then loosely placed on a filled container when the filled container is received from the bottle intake star. Upon further rotation of the bottle and associated cap on the capping turret, the chuck member of the capping head assembly engages the cap and is operated to tighten the cap onto the bottle. Magnets have been used before to remove steel lug caps from cap transfer mechanisms, but there has always been the concern that these caps may be scratched, or otherwise damaged due to abrasive particles affixing themselves to the magnets or as a result of frictional contact within the chuck mechanism.

In order to prevent damage to the cap, a friction tip made of a silicone, caulking type of compound serving as an adhesive is secured to the outer surface of the magnets and acts as a high friction material relative to the cap. Thus, when the cap is withdrawn from the transfer mechanism by the magnets there is no direct contact between the magnets and the cap that could possibly scratch the top of the cap nor function to wear out the magnets. Furthermore, the adhesive functions to maintain the central position of the cap relative to the pickup assembly. To further prevent scratching of the sides of the cap while it is located within the chuck, there are provided replaceable urethane inserts which engage the cap when the cap is in the chuck and functions to turn the cap when a clutch is engaged to torque the cap onto the container. If these inserts become worn, they can be readily replaced.

With these novel features incorporated in the rotary capping mechanism, there is provided a much more efficient and effective rotary capping mechanism for use in the industry.

It is to be noted that there are other rotary capping mechanisms currently available on the market, but these do not have the very desirable features contained in the instant application. A patent disclosing a capping mechanism of the general type which does not provide the novel inventive features disclosed herein is U.S. Pat. No. 3,345,800 to Volker. This patent discloses a capping mechanism that uses a magnet to withdraw a cap from a rotary conveyor but does not contain the various novel features of applicant's invention in combination with other components of a rotary capping machine.

Other advantages and features of the present invention will be understood from the following drawings, in which:

DETAILED DESCRIPTION

Figure 1:
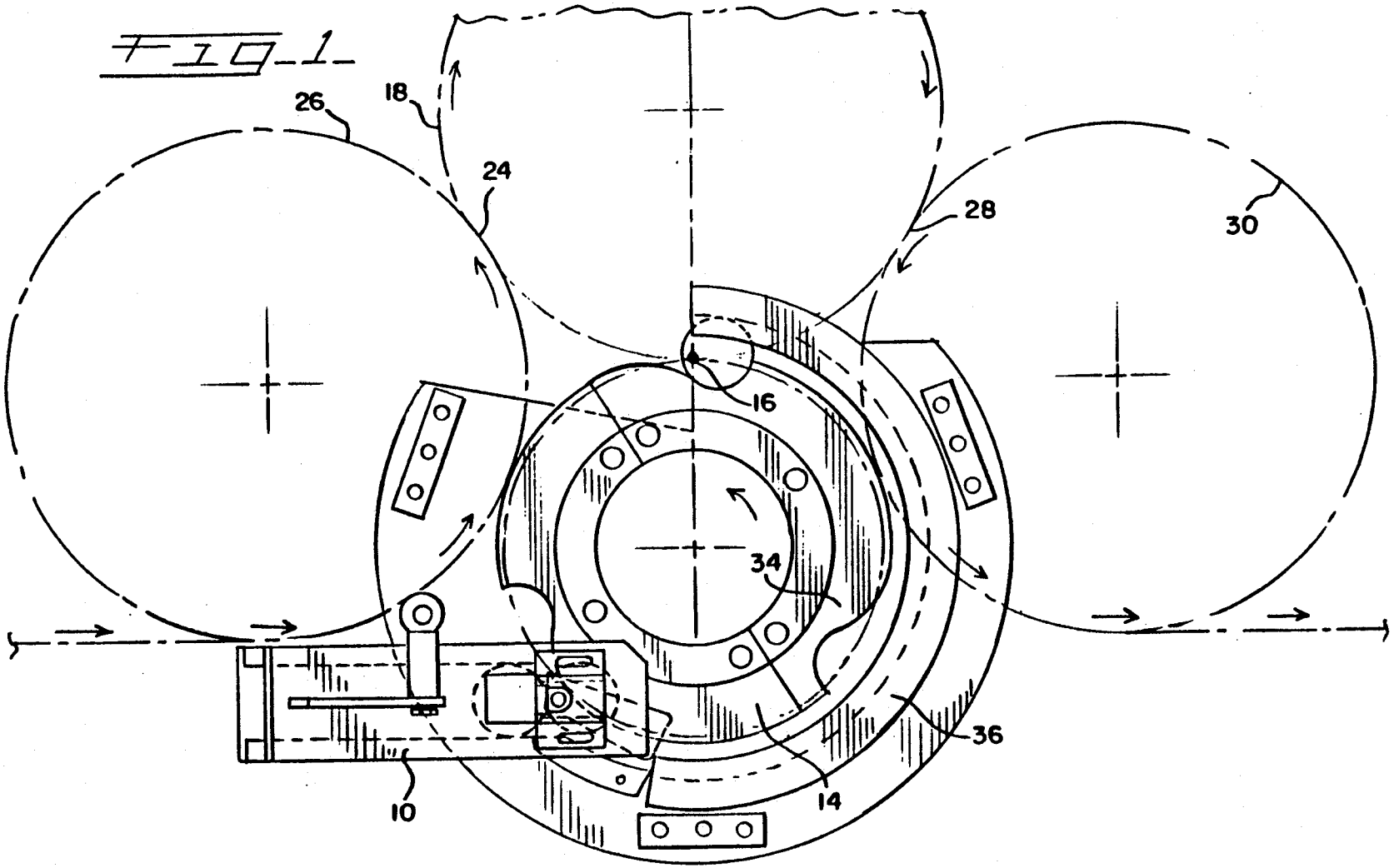
FIG. 1 shows an overall schematic mechanism illustrating the various conveyors, etc., that form part of a rotary capping mechanism.

While the present invention is susceptible of embodiment in various forms, there is shown in the drawings and will hereinafter be described a presently preferred embodiment of the invention, with the understanding that the present disclosure is to be considered as an exemplification of the invention, and is not intended to limit the invention to the specific embodiment illustrated.

Referring now to FIG. 1, there is shown in schematic outline a plan view of the various components of a rotary capping mechanism which incorporate novel features to which this application is directed. Since the major components of the capping mechanism are considered conventional and do not form a part of the present invention, this application will not be burdened with the details thereof. Accordingly, FIG. 1 is provided to supply a general outline of a rotary capping mechanism and is merely intended to provide an overview of the various mechanisms found in a rotary capping system. The various mechanisms are only schematically illustrated and where further details are desired of mechanisms that can be employed to accomplish the functions listed, the reader is directed to Bernardin U.S. Pat. No. 527,193, which discloses a machine for applying a metallic cap to the head of a bottle; Shriner U.S. Pat. No. 799,095, which illustrates a rotary feed device for caps; Fouse U.S. Pat. No. 2,610,779 which uses a star wheel to feed closures and a capping mechanism that employs a rotating sealing chuck that operates with a friction clutch that slips to prevent the cap from being applied too tightly; and Volker U.S. Pat. No. 3,345,800, which describes in substantial detail a rotary capping mechanism containing many of the general features found in rotary capping machines of the type disclosed in the instant application. Thus, details of various mechanisms, such as those used for feeding filled containers, capping them, torquing the caps on the filled containers while holding the containers in position to receive the caps, removing filled and sealed containers from the capping turret an conveying them for further packaging form no part of the present invention and will only be referred to where necessary for an understanding of the present invention.

Briefly, caps are provided from a cap feeder assembly 10 which directs caps 12 onto a cap-transfer star mechanism 14. The cap transfer mechanism 14 is driven in a counter-clockwise direction by the main drive mechanism (not shown) to move the caps 12 to a transfer point 16 where the capping turret assembly 18 is tangent to the cap transfer mechanism and a capping head 20 removes a cap 12 from the cap transfer mechanism. The cap transfer mechanism moves successive caps in a path which intersects the path of the capping turret at a transfer station to supply caps to said capping heads in timed relation with said capping turret. The capping turret 18 is driven by the main drive mechanism in a clockwise direction to move the capping head 20 containing the cap 12 to transfer point 24, where the turret 18 is tangent to the bottle entry conveyor 26, which is moving in a counterclockwise direction. At the transfer point 24, the capping turret assembly picks up the filled bottle from the entry conveyor 26 and retains the bottle (not shown) in position while a cap 12 is torqued onto the bottle.

The capping turret assembly includes suitable mechanisms to support the jar being filled in axial alignment with its respective capping head so that the jars are rotated with the capping heads and accurately and tightly capped the rotation of the capping turret assembly. In this latter function of torquing the cap onto the bottle the requisite amount is determined by a suitable clutch and torquing mechanism (not shown). Affixing the cap to the bottle takes place during an approximately 220° clockwise rotation of the capping turret to where the bottle and affixed closure are removed from the capping turret. When a capping head 20 carrying a filled and capped bottle reaches transfer point 28, where the capping turret is tangent to the exit star 30, the filled container and secured cap are transferred onto the exit star 30 which moves in a counterclockwise direction and moves the filled container for further packaging.

As previously mentioned, the details of the bottle entry conveyor 26, capping turret assembly 18, exit star 30 and cap transfer-star mechanism 14 are conventional and will only be referred to in particular detail where they interact with any features of the present invention. Otherwise, if further information regarding these types of conventional mechanisms is required, reference is again made to the patents referred to above.

Figure 2:
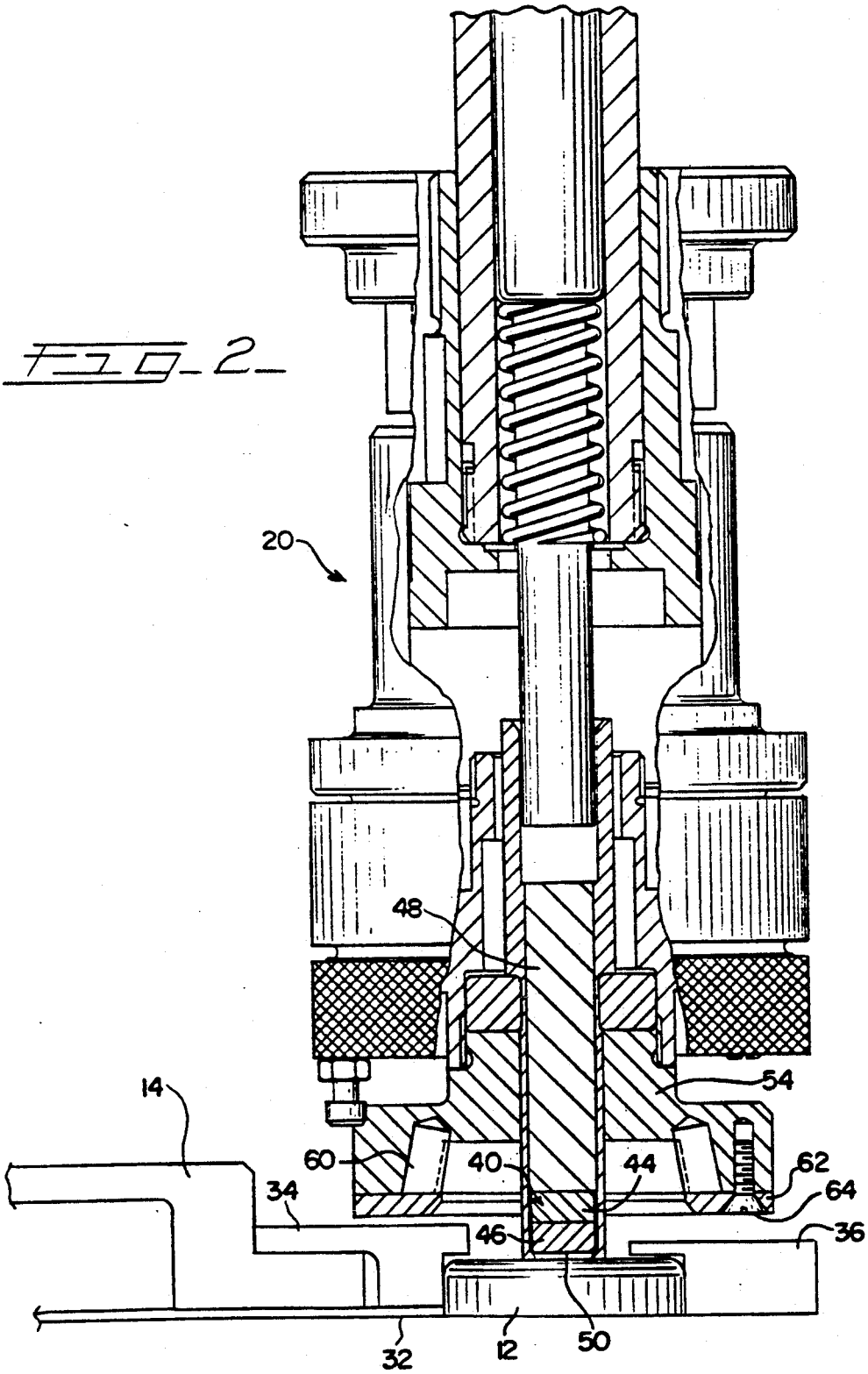
FIG. 2 is an enlarged view of a capping head.
Figure 3:
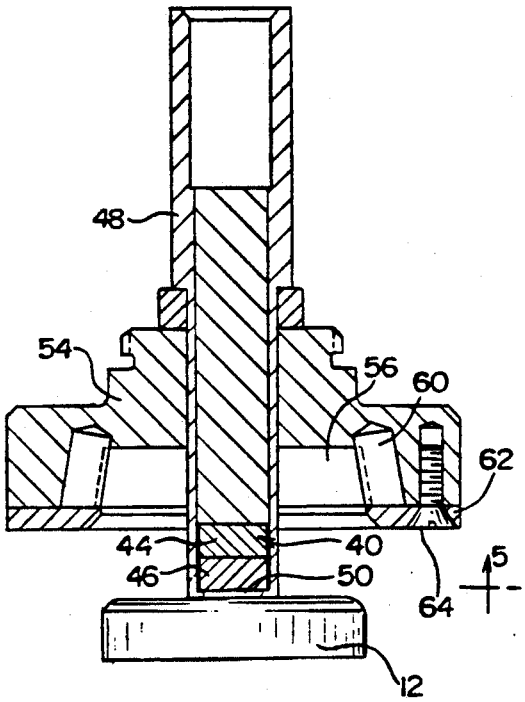
FIG. 3 is a cross-sectional view showing the magnet assembly of the present invention engaging the cap to remove it from the transfer star wheel.
Figure 4:
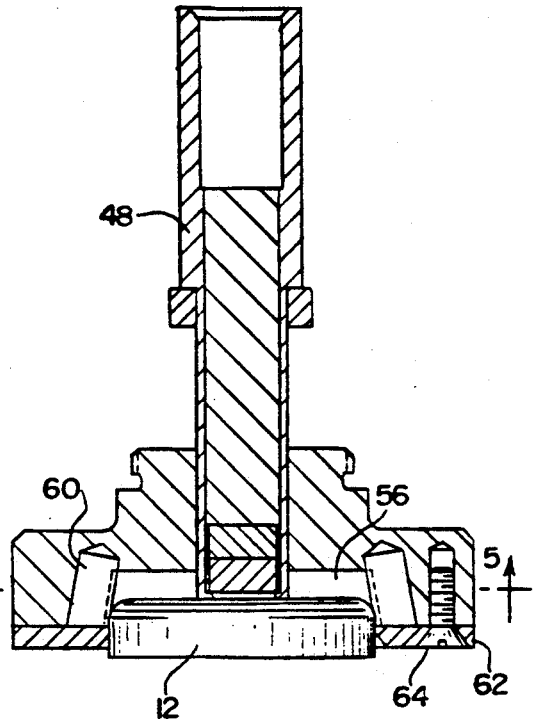
FIG. 4 is a view showing the chuck in position surrounding the cap for torquing it onto a container.
Figure 5:
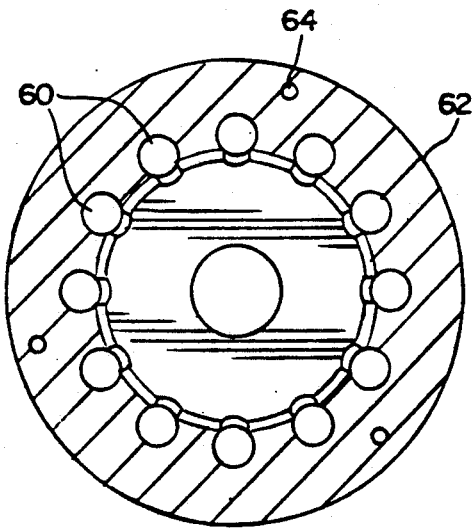
FIG. 5 is a view taken along line 5—5 of FIG. 4 showing the disposition of the replaceable urethane inserts.

Referring now to FIG. 2, there is shown a capping head assembly 20 which has been moved downwardly in position to remove the cap 12 from the cap transfer mechanism 14. The details of the capping head assembly relative to the instant invention will be discussed hereinafter. Reference now, however, is to be made to the novel features of the cap transfer mechanism 14 which insures that the cap 12 is retained in proper position on the cap transfer mechanism 14 so that when the capping head is moved into contact with the cap to remove the cap from the cap transfer mechanism, the cap will be properly oriented for reception by the capping head 20.

To accomplish the desired result in accordance with the present invention, the cap 12 is located in a recess (not shown) defined by the cap transfer starwheel and it rests on a support 32. The cap 12 is securely held in position relative to the support 32 for accurate removal from the cap transfer star by an overhanging plate member 34 of the cap transfer mechanism and a diametrically disposed cap guide 36. As shown in FIG. 1, these guide members extend over the cap to keep them from jumping around during the rotating movement of the cap transfer mechanism. The guide member 36 extends approximately 200° between the cap feeder assembly 10 and the cap transfer point 16.

The cap transfer star mechanism 14 successively moves caps 12 in a counterclockwise direction to the transfer point 16, where the cap is picked up by the magnetic assembly 40 forming part of each capping head 20 on the capping turret 18. The magnetic assembly, as shown in FIG. 2, forms part of each vertically movable capping head assembly 20. The capping head assembly 20 includes magnets 44,46 located at the end of a longitudinally movable rod assembly 48. Secured to the end of the magnet 46 and positioned to engage the cap 12 is a friction tip 50 which is made of a silicone caulking type compound that serves as an adhesive. The silicone compound prevents damage to the magnets by preventing contact with the magnet and the friction tip 50 prevents slippage of the cap and thus retains the cap in its proper position for disposition on a container. The tip 50 also prevents damage to the cap by virtue of the smooth contact between the cap and the friction tip 50 secured to the magnet.

Other than the novel features referred to herein, the capping head is of a conventional design and includes a chuck 54 which is driven through a clutch (not shown) to fasten a cap to a container.

Briefly, the method of operation is as follows:

A cap is deposited on the star wheel mechanism 14 by the cap feeder assembly 10. Rotation of the star wheel carries the cap to the transfer point 16 where the tip 50 of the rod assembly 48 in its lowered position engages the cap and the magnetic assembly transfers the cap to the capping head 20. The capping head 20 and associated rod assembly carries the cap in a floating condition to the transfer point 24 where it is loosely deposited on a bottle located on the container entry conveyor 26. The filled bottle on the bottle entry conveyor is transferred to the capping turret assembly and retained thereon in axial alignment with a capping head. The capping turret assembly continues to rotate through another approximately 240°, during which time the chuck 54 is lowered to contain the cap within the chuck cavity 56 and the cap is torqued onto the container with the proper torque. Suitable conventional mechanisms are provided for limiting the amount of torque applied to the cap.

Located within the cavity 56 are a plurality of circumferentially spaced polyurethane inserts 60 which engage the cap to facilitate rotating the cap relative to the container such as a bottle to secure the cap 12 to the bottle. These inserts contact the cap 12 and due to their composition do not damage the cap during application.

In the event the inserts wear and replacement becomes necessary, it is merely necessary to remove the insert cover 62, which is secured to the chuck 54 by screws 64.

At transfer point 28, there is contact between the capping turret and the exit conveyor 30, where the capped container is removed from the capping turret 18 to the exit conveyor 30 from where it is moved for further packaging.

It is intended to cover by the appended claims all embodiments which fall within the true spirit and scope of the invention.

What is claimed is:

1. The machine for applying caps having tops and sidewalls to containers including a capping turrent assembly on which there are located a plurality of circumferentially spaced longitudinally movable, rotatably driven capping head assemblies and a rotating cap transfer mechanism intersecting said capping turrent assembly at a transfer station, means for feeding successive caps to said transfer mechanism, said cap transfer mechanism advancing successive caps in a path which intersects a path of a capping head assembly at the transfer station to supply caps to said capping head assemblies in timed relation with said capping turrent assembly, means on said transfer mechanism positioning caps thereon to insure proper location for transfer to said capping turrent assemblies, said means for positioning said caps comprising diametrically disposed guides positioned to engage the top of said caps after they are received by said transfer mechanism and during transfer to said capping head assemblies to prevent the caps from moving out of position, each of said capping head assemblies including a chuck means defining a cavity for receiving a cap, a centrally disposed rod assembly extending through said cavity, said rod assembly including a magnetic pickup device comprising a magnet means, said magnet means having a friction tip composed of a silicone compound secured to said magnet means and adapted to contact a cap, a plurality of urethane insert means circumferentially disposed within said cavity and positioned to engage said cap, and means for moving a capping head assembly into contact with the cap at said transfer station to transfer the cap from the transfer mechanism to a capping head assembly and rotate said cap onto a container.

* * * * *